US010395604B2

(12) United States Patent
Mio

(10) Patent No.: US 10,395,604 B2
(45) Date of Patent: Aug. 27, 2019

(54) LED DRIVING CIRCUIT, LED DRIVING METHOD, AND LIQUID CRYSTAL DISPLAY DEVICE

(71) Applicant: NLT Technologies, Ltd., Kawasaki, Kanagawa (JP)

(72) Inventor: Setsuko Mio, Kanagawa (JP)

(73) Assignee: NLT TECHNOLOGIES, LTD., Kawasaki, Kanagawa (JP)

( * ) Notice: Subject to any disclaimer, the term of this patent is extended or adjusted under 35 U.S.C. 154(b) by 125 days.

(21) Appl. No.: 14/518,093

(22) Filed: Oct. 20, 2014

(65) Prior Publication Data

US 2015/0124003 A1 May 7, 2015

(30) Foreign Application Priority Data

Nov. 1, 2013 (JP) ..... 2013-228789

(51) Int. Cl.
*G09G 3/34* (2006.01)
*G09G 3/36* (2006.01)

(52) U.S. Cl.
CPC ..... *G09G 3/3406* (2013.01); *G09G 2320/064* (2013.01)

(58) Field of Classification Search
CPC ..... G09G 3/32; G09G 3/3406; G09G 3/3648; G09G 2320/064; H05B 33/0815
See application file for complete search history.

(56) References Cited

U.S. PATENT DOCUMENTS

2006/0175986 A1* 8/2006 Lee ..... G09G 3/342 315/312
2009/0219244 A1* 9/2009 Fletcher ..... G09G 3/3406 345/102

(Continued)

FOREIGN PATENT DOCUMENTS

JP 2009-238633 A 10/2009
JP 2011-228063 A 11/2011

(Continued)

OTHER PUBLICATIONS

JP2012227075A_diagram ENG.pdf, the English machine translation of JP2012227075A, Published Nov. 15, 2012, made of record in the IDS submitted Sep. 5, 2017.*

(Continued)

*Primary Examiner* — Wing H Chow
(74) *Attorney, Agent, or Firm* — Sughrue Mion, PLLC

(57) ABSTRACT

An LED driving circuit, an LED driving method, and a liquid crystal display device, which prevent deterioration of display quality by effectively shortening the time required for starting the LED backlight and stabilizing the driving operations are provided. The LED driving circuit for controlling an LED circuit constituted with one LED or two or more LEDs includes: a duty ratio adjusting circuit unit which generates/outputs adjusting signals for adjusting drive of the LED based on a PWM dimming signal inputted from outside; and a booster circuit unit which applies driving voltages to the LED circuit according to the adjusting signal outputted from the duty ratio adjusting circuit unit. The duty ratio adjusting circuit unit sets the adjusting signal to have a larger duty ratio than that of the PWM dimming signal within an adjusting period set after the power is supplied until the LED circuit starts to connect electrically.

14 Claims, 12 Drawing Sheets

(56) References Cited

U.S. PATENT DOCUMENTS

| | | | | |
|---|---|---|---|---|
| 2012/0299512 | A1* | 11/2012 | Watanabe | H05B 33/0845<br>315/307 |
| 2013/0043803 | A1* | 2/2013 | Raj | H05B 33/0896<br>315/241 R |

FOREIGN PATENT DOCUMENTS

| | | | |
|---|---|---|---|
| JP | 2012227075 | A | 11/2012 |
| JP | 2012-243688 | A | 12/2012 |

OTHER PUBLICATIONS

Communication dated Aug. 17, 2017, from the Japanese Patent Office in counterpart Japanese application No. 2013-228789.

* cited by examiner

LED DRIVING CIRCUIT, LED DRIVING METHOD, AND LIQUID CRYSTAL DISPLAY DEVICE

CROSS-REFERENCE TO RELATED APPLICATION

This application is based upon and claims the benefit of priority from Japanese patent application No. 2013-228789, filed on Nov. 1, 2013, the disclosure of which is incorporated herein in its entirety by reference.

BACKGROUND OF THE INVENTION

1. Field of the Invention

The present invention relates to a driving control technique for a backlight that is provided to a liquid crystal display device or the like. More specifically, the present invention relates to an LED driving circuit for adjusting operations of an LED backlight, an LED driving method, and a liquid crystal display device.

2. Description of the Related Art

Recently, as an LCD (Liquid Crystal Display) backlight, an LED (Light Emitting Diode) has been used broadly from the viewpoints of long life, low power consumption, and reduction in the load on the environments (mercury free).

With an LED driving circuit on which the LED is mounted, generally known is a method which supplies an output voltage between an anode and a cathode by a booster circuit at the time of light-up, and supplies a current adjusted by a constant current circuit to the LED. With such method, the booster circuit is associated with the constant current circuit. That is, control of the output voltage is executed by feeding back the result acquired by monitoring the current by the constant current circuit to the booster circuit.

Further, as an LED dimming method, a current pulse dimming method (PWM dimming method) by PWM (pulse width modulation) is normally used for avoiding changes in the hues of the LED caused by changes in the current and based on the reason that it is easy to keep the correlativity of the relation between dimming and the luminance.

In the technical field related to the PWM dimming method, there is known a control circuit which has a function for prohibiting a boosting operation when the pulse is "Low", i.e., when the LED is "OFF". With this control circuit, no current is flown into the constant current circuit during a period where the LED is in an "OFF" state. This is a structure for avoiding an issue of excessive consumption of the electric power because the booster circuit turns to an overvoltage state when the booster circuit continuously boosts up for flowing the current to the LED under a feedback control.

However, with this control circuit, when the duty of the PWM is low, the influence upon the characteristic of the driving circuit and the display quality becomes great since the operation period of the booster circuit is short.

Japanese Unexamined Patent Publication 2011-228063 (Patent Document 1) and Japanese Unexamined Patent Publication 2009-238633 (Patent Document 2) are known as the techniques for overcoming such issues regarding the control circuit.

Patent Document 1 discloses a technical content which stores the output voltage in a period (PWM-ON period) where the LED array is lighted up as a reference voltage at the time of PWM dimming, holds the reference voltage even in a period (PWM-OFF period) where the LED array is turned off, and executes a boosting operation based thereupon so as to suppress drop of the applied voltage between the anode and the cathode and to suppress flicker of the LED caused due to the change in the voltage.

In order to avoid such an issue that a long time is required for boosting up to the optimum voltage between the anode and the cathode since the operating time of the booster circuit is extremely short at the time of starting up the power source when the duty ratio of the PWM dimming is small, Patent Document 2 discloses a technical content which shortens the time from the point at which the power is supplied to the point at which the LED is lighted up through providing a bypass circuit in addition to the LED circuit, operating the booster circuit (switching power source) with a pre-duty ratio set in advance via the bypass circuit without connecting to the LED circuit immediately after starting the power source, and switching to the LED circuit after boosted up to a prescribed voltage.

Further, as a technique for avoiding flash at the time of starting light-up in a case where the power source is started under PWM dimming, there is the technique disclosed in Japanese Unexamined Patent Publication 2012-243688 (Patent Document 3).

Regarding the dimming signal generating device disclosed in Patent Document 3, disclosed is a technical content for avoiding dimming of the LED with the duty ratio of 100% immediately after supply of the power source through providing a circuit which is capable of generating a pseudo PWM signal based on an alternating-current power source until the circuit for generating a PWM signal (a dimming signal generating circuit) starts an operation.

However, the dimming circuit according to Patent Document 1 executes a prescribed boosting operation in an OFF period based on the reference voltage held in an ON period right before, so that the voltage of the ON period right before can be maintained in the OFF period but the voltage cannot be boosted up than that of the ON period right before. That is, the boost-up time cannot be shortened greatly when it is desired to perform an operation for gradually increasing the anode voltage, e.g., when starting up the power source.

The LED driving circuit according to Patent Document 2 can shorten the boost-up time of the anode voltage. However, it is necessary to bypass the current for each of the parallel number of the LEDs in the structure of the bypass circuit and the power bypassed for each of the series number varies. Thus, the circuit structure becomes complicated and large-scaled as the number of the LEDs is increased, so that it is difficult to use the circuit in common.

Further, the current capacitance and the voltage rating equivalent to those of the LED circuit are required for the bypass circuit herein. Therefore, the bypass circuit is required for each type of the LED circuits, so that the circuit scale is increased.

Further, the LED driving circuit is structured to supply the current even in a period where the LED is not lighted up, so that there is such an issue that the power is excessively consumed in the no light-up period. In addition, there is a shift period in which the LED side and the detour route side (bypass side) are both in an ON state, so that there is a possibility of causing more excessive consumption of the power in the shift period.

Further, employed herein is a structure with which the bypass circuit and the LED circuit are switched in a voltage/current state where the LED is lighted up. Thus, there is a concern that flicker or the like may be visually recognized due to current ripple and voltage noise of the circuit generated at the time of switching or immediately after switching. That is, there is a possibility of causing display quality deterioration.

Furthermore, the technical content disclosed in Patent Document 3 is to generate a pseudo PWM signal based on the AC power source for avoiding flashing and flicker when starting the light-up of the device LED. In this case, it is effective for avoiding flashing if the pseudo signal is fixed depending on the external power source and the dimming duty ratio of the signal generating device is fixed and is higher than that of the pseudo PWM signal. However, as the LED driving circuit, it is inconvenient for a case where PWM is inputted as an external signal to change the duty ratio.

The present invention is for improving the inconveniences of the related techniques of the LED driving circuit. More specifically, it is an exemplary object of the present invention to provide an LED driving circuit and an LED driving method for preventing deterioration of the display quality such as flicker through effectively shortening the time required for starting up the LED backlight and stabilizing the driving operations thereof, and to provide a liquid crystal display device using the same.

SUMMARY OF THE INVENTION

In order to achieve the foregoing object, the LED driving circuit according to the present invention is an LED driving circuit for controlling an LED circuit constituted with one LED or two or more LEDs, and the LED driving circuit employs a structure which includes: a duty ratio adjusting circuit unit which generates and outputs an adjusting signal for adjusting drive of the LED based on a PWM dimming signal inputted from outside; and a booster circuit unit which applies a driving voltage to the LED circuit according to the adjusting signal outputted from the duty ratio adjusting circuit unit, wherein the duty ratio adjusting circuit unit sets the adjusting signal to have a larger duty ratio than that of the PWM dimming signal inputted from outside within an adjusting period set from a point after a power is supplied to a point at which the LED circuit starts to connect electrically.

Further, the liquid crystal display device according to the present invention employs a structure which includes: a liquid crystal display panel which displays a video towards outside; a backlight which includes an LED circuit constituted with one LED or two or more LEDs and illuminates the liquid crystal panel from a back surface; and the LED driving circuit which drives the LED circuit by using a power supply voltage outputted from and the PWM dimming signal inputted from outside.

Furthermore, the video signal processing method according to the present invention is used with an LED driving circuit which includes a booster circuit unit which applies a driving voltage to an LED circuit constituted with one LED or two or more LEDs and a duty ratio adjusting circuit unit which generates and outputs an adjusting signal for adjusting drive of the LED circuit, and the method includes: inputting a PWM dimming signal used for controlling operations of the LED circuit from outside to the duty ratio adjusting circuit unit; generating and outputting the adjusting signal having a larger duty ratio than that of the PWM dimming signal by the duty ratio adjusting circuit unit within an adjusting period set in advance from a point after a power is supplied to a point at which the LED circuit starts to connect electrically; and applying a voltage by the booster circuit unit to the LED circuit according to the adjusting signal outputted from the duty ratio adjusting circuit unit.

DETAILED DESCRIPTION OF THE PREFERRED EMBODIMENTS

First Exemplary Embodiment

A first exemplary embodiment of an LED driving circuit according to the present invention will be described by referring to FIG. 1 to FIG. 4.

(Overall Structures)

Figure 1:
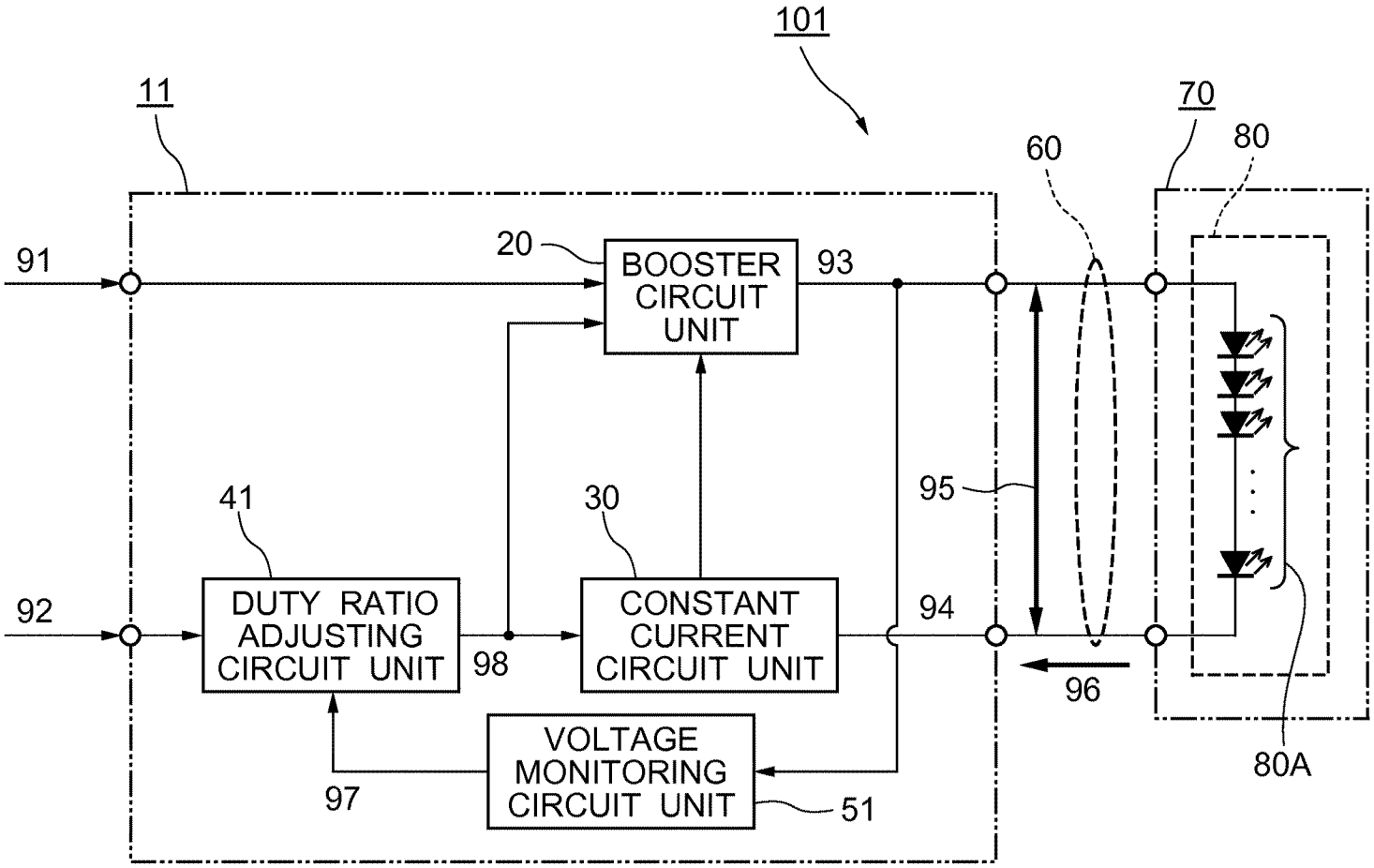
FIG. 1 is a block diagram showing an LED driving circuit according to a first exemplary embodiment of the present invention and the peripheral structure thereof.

As shown in FIG. 1, an LED lighting device 101 provided to a liquid crystal display device (a video display device) according to the first exemplary embodiment includes: an LED backlight 70 which illuminates a display panel (not shown) such as a liquid crystal panel from the back surface; and an LED driving circuit 11 which performs driving controls regarding the LED backlight 70.

The LED backlight 70 shown in FIG. 1 includes an LED circuit 80 which is constituted by containing an LED group 80A in which a plurality of LEDs are connected in series. As the LED group 80A, it is also possible to employ a structure in which two or more LEDs are connected in parallel, a structure in which a serial connection and a parallel connection are combined variously, etc. Understandably, it is also possible to employ a single LED instead of the LED group 80A.

That is, the LED driving circuit 11 which drives the LED circuit 80 constituted by containing one LED or two or more LEDs includes: a booster circuit unit 20 which applies a driving voltage between an anode and a cathode of the LED circuit 80 by using a power supply voltage 91 inputted from outside; a constant current circuit unit 30 which adjusts an LED current 96 that is an electric current flown into the LED circuit 80 to be in a constant amount; and a duty ratio adjusting circuit unit 41 which generates an adjusting signal (a duty adjusting signal 98) used for adjusting drive of the LED circuit 80 based on a PWM dimming signal 92 inputted from outside and transmits it to the booster circuit unit 20 and the constant current circuit unit 30.

The duty ratio adjusting circuit unit 41 is structured to generate a signal (a Hi adjusting signal) which has a larger duty ratio than that of the PWM dimming signal 92 as the adjusting signal 98 within an adjusting period (a duty adjusting period) that is set in advance between the point at which the power is supplied and the point at which an electric current starts to flow in the LED circuit 80.

That is, within the adjusting period set between the point at which the power is supplied and the point at which electrical connection (light-up) of the LED circuit is started, the duty ratio adjusting circuit unit 41 transmits the adjusting signal 98 as the duty ratio larger than the PWM dimming signal 92, and the booster circuit unit 20 applies a voltage to the LED circuit 80 according to the adjusting signal 98 transmitted from the duty ratio adjusting circuit unit 41.

Further, the LED driving circuit 11 includes a voltage monitoring circuit unit 51 which monitors an anode voltage 93 of the LED circuit 80 and transmits a signal (a duty control signal 97) to the duty ratio adjusting circuit unit 41 based on the voltage monitoring.

Note here that the adjusting period according to the first exemplary embodiment is structured to be a period from the point immediately after the power supply voltage 91 is inputted to the point at which the anode voltage 93 monitored by the voltage monitoring circuit unit 51 reaches a threshold voltage set in advance.

That is, the voltage monitoring circuit unit 51 is structured to start continuous monitoring of the anode voltage 93 which shows the potential on the anode side of the LED circuit 80 when the power supply voltage 91 and the PWM dimming signal 92 are inputted (at the time of starting the power supply voltage: at the time of supplying the power) and to transmit the duty control signal 97 that is a larger duty ratio than that of the PWM dimming signal 92 to the duty ratio adjusting circuit unit 41 until the anode voltage 93 reaches the threshold value as the result of the monitoring.

Note here that the threshold voltage is set to a smaller voltage value than the voltage value (the anode voltage 93) required for lighting up all the LEDs constituting the LED circuit 80 (set to be smaller than the anode voltage 93 of the point at which the electric current starts to flow in the LED circuit 80).

The threshold voltage is desired to be close to the anode voltage 93 as much as possible. However, the anode voltage 93 changes depending on the temperature condition and the like. Thus, an arbitrary voltage with which the electric current does not flow in the LED circuit 80 is set in advance by taking the characteristic and use conditions of the LED into consideration.

The duty ratio adjusting circuit unit 41 is structured to change the duty ratio of the adjusting signal 98 based on the duty control signal 97 received from the voltage monitoring circuit unit 51 and the PWM dimming signal 92 inputted from outside. More specifically, the adjusting signal 98 generated by the duty ratio adjusting circuit unit 41 is a signal acquired by synchronizing the duty control signal 97 transmitted from the voltage monitoring circuit unit 51 with the PWM dimming signal 92 inputted from outside.

That is, the duty adjusting circuit unit 41 employs a structure which controls adjustment of the duty ratio based on the duty control signal 97, generates the adjusting signal 98 by synchronizing with the PWM dimming signal 92, and transmits the generated adjusting signal 98 to the booster circuit unit 20 and the constant current circuit unit 30. Thereby, the boosting operation done by the booster circuit unit 20 can be shortened and the time required for starting up the LED circuit 80 can be stabilized.

Further, the duty ratio adjusting circuit unit 41 employs a structure which, in the adjusting period that is the period between the point at which the power supply voltage is started and the point at which the anode voltage 93 reaches the threshold voltage, generates the adjusting signal 98 having a specific duty ratio whose ON period is longer than that of the PWM dimming signal 92 based on the duty control signal 97.

The anode and the cathode of the LED circuit 80 are connected to the booster circuit unit 20 and the constant current circuit unit 30 of the LED driving circuit 11 via a connection line 60, respectively. That is, the output terminal of the booster circuit unit 20 is connected to the anode side of the LED circuit 80, and the cathode side of the LED circuit 80 is connected to the constant current circuit unit 30. As the connection line 60, it is possible to employ a cable such as an FFC (Flexible Flat Cable), FPC (Flexible printed circuits), or the like.

Further, as shown in FIG. 1, the anode side of the LED circuit 80 is also connected to the voltage monitoring circuit unit 51.

As described, the voltage monitoring circuit unit 51 is structured to monitor the anode voltage 93. Therefore, it is possible to generate the duty control signal 97 which corresponds to the operation of the booster circuit unit 20 and to determine the adjusting period according to the operation of the booster circuit unit 20.

The LED has such a characteristic that the electric current starts to flow after the voltage between the anode and the cathode reaches a specific voltage, and the voltage between the anode and the cathode is generally referred to as a forward voltage (VF). That is, the LED is characterized not to conduct the electric current until the forward voltage reaches the prescribed voltage and does to start up during that period.

Hereinafter, the forward voltage is referred to as VF95. The VF95 is a potential difference between the anode voltage 93 shown in FIG. 1 and the cathode voltage 94 which shows the potential on the cathode side of the LED circuit 80.

In the first exemplary embodiment, the structure which effectively utilizes the period from the point at which the voltage is supplied to the point at which the LED group 80A is started up (lighted up) is employed for the LED driving circuit 11 by taking the above-described characteristics of the LED into consideration.

That is, with the structure with which the adjusting period is set within the period from the point at which the power supply voltage is supplied to the point at which the forward voltage VF95 reaches the inherent voltage value at which the LED group 80A starts to light up and the duty ratio adjusting circuit unit 41 transforms the PWM dimming signal 92 into the adjusting signal 98 having a relatively large duty ratio and gives it to the booster circuit unit 20 provided in a latter stage in that adjusting period, the boosting operation by the booster circuit unit 20 can be sped up and the time required for starting up (lighting up) the LED group 80A (time required for starting up the LED circuit 80) can be shortened.

Note here that the booster circuit unit 20 is a structure for applying the VF95 to the LED circuit 80, and the constant current circuit unit 30 is a structure which flows the specific LED current 96 for lighting up the LED backlight 70 with prescribed luminance and switches ON/OFF of the electric current based on the duty of the PWM signal 98 for performing control of dimming. Further, the constant current circuit unit 30 executes boosting operations so that the VF95 can be an optimum voltage through monitoring the LED current 96 and sending the result as a feedback signal 99 to the booster circuit unit 20.

The booster circuit unit 20 and the constant current circuit unit 30 are structured to perform the control for changing the luminance of the LED with the PWM signal, so that it is possible to execute the ON/OFF operations according to the adjusting signal 98 that is the PWM signal received from the duty ratio adjusting circuit unit 41.

In order to prevent the power from being excessively consumed, the booster circuit unit 20 is structured to stop the boosting operation when the pulse is in an OFF state under a normal PWM control. Therefore, the PWM signal inputted to the booster circuit unit 20 is structured in such a manner that the time for boosting up to a specific voltage (boosting time) becomes longer as the duty ratio thereof is lower and the boosting time becomes shorter as the duty ratio is higher.

In the first exemplary embodiment, the boosting circuit unit 20 drives according to the adjusting signal 98 (the duty ratio is assumed to be 100%, which also applies in the followings) whose ON period is longer than that of the PWM dimming signal 92 in the adjusting period. Thus, the lower the duty ratio of the PWM dimming signal 92, the more the difference in the duty ratios between the PWM dimming signal 92 and the adjusting signal 98 becomes prominent. Therefore, the OFF time (=boosting rest time) of the adjusting signal 98 becomes relatively short, so that the time required for boosting up to a prescribed voltage can be shortened.

Note here that the electric current value flown in the LED changes according to the forward voltage (VF) applied between the anode and the cathode, and a typical LED exhibits a characteristic of conducting a greater amount of electric current as the forward voltage becomes higher. Further, as described above, the LED exhibits a characteristic of starting conduction of the electric current after the forward voltage reaches a specific value.

In view of such characteristics of the LED, the first exemplary embodiment employs the structure with which: the constant current circuit unit 30 starts continuous monitoring of the electric current at the time of starting up the power supply voltage; the constant current circuit unit 30 boosts up the voltage by controlling the booster circuit unit 20 until a point where the electric current reaches a prescribed electric current value as the result of the monitoring; and, when the electric current reaches the prescribed electric current value, the constant current circuit unit 30 performs a feedback control for the booster circuit unit 20 to stop the boosting operation being executed.

Therefore, the boosting operation by the booster circuit unit 20 can be suppressed significantly after the LED current 96 starts to flow (after the LED group 80A starts to light up), so that the brightness at the time of light-up can be increased more naturally.

Figure 2:
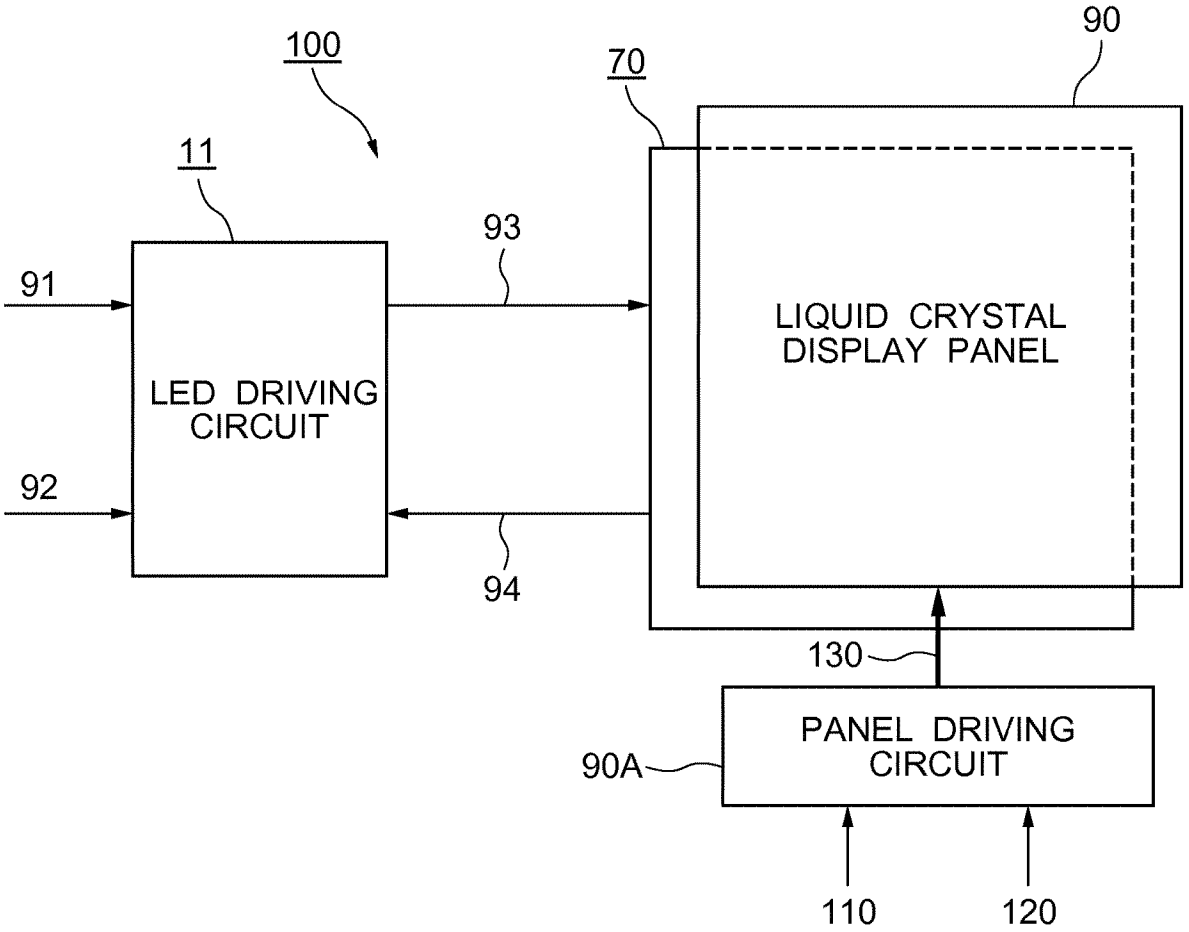
FIG. 2 is a schematic view of a liquid crystal display device according to the first embodiment which includes the LED driving circuit disclosed in FIG. 1.

Further, as shown in FIG. 2, the liquid crystal display device 100 according to the first exemplary embodiment includes, on the light emission surface side of the LED backlight 70, a liquid crystal display panel 90 in which pixels are arranged according to a specific rule, and a panel driving circuit 90A which operates by a power supply voltage 110 supplied from outside and outputs a driving signal 130 generated based on a video signal 120 inputted from outside to the liquid crystal display panel 90.

That is, FIG. 2 is a schematic view clearly showing the liquid crystal panel 90 which displays a video towards the outside based on the driving signal 130 from the panel driving circuit 90A by receiving the light from the LED backlight 70 on the back surface. Further, each structural member shown in FIG. 1 is partially simplified, and same reference numerals are applied to the structural contents that are common in each of the drawings.

Next, the state of the signals and the like transmitted and received by the LED light device 101 disclosed in FIG. 1 will be described by referring to a time chart shown in FIG. 3.

Here, the threshold voltage to which the voltage monitoring circuit unit 51 refers when monitoring the anode voltage 93 is expressed as the threshold voltage (Vmsk). In the first exemplary embodiment, employed is the circuit structure with which the voltage value acquired by subtracting the cathode voltage 94 from the anode voltage 93 becomes the same value as the value of the VF95.

Figure 3:
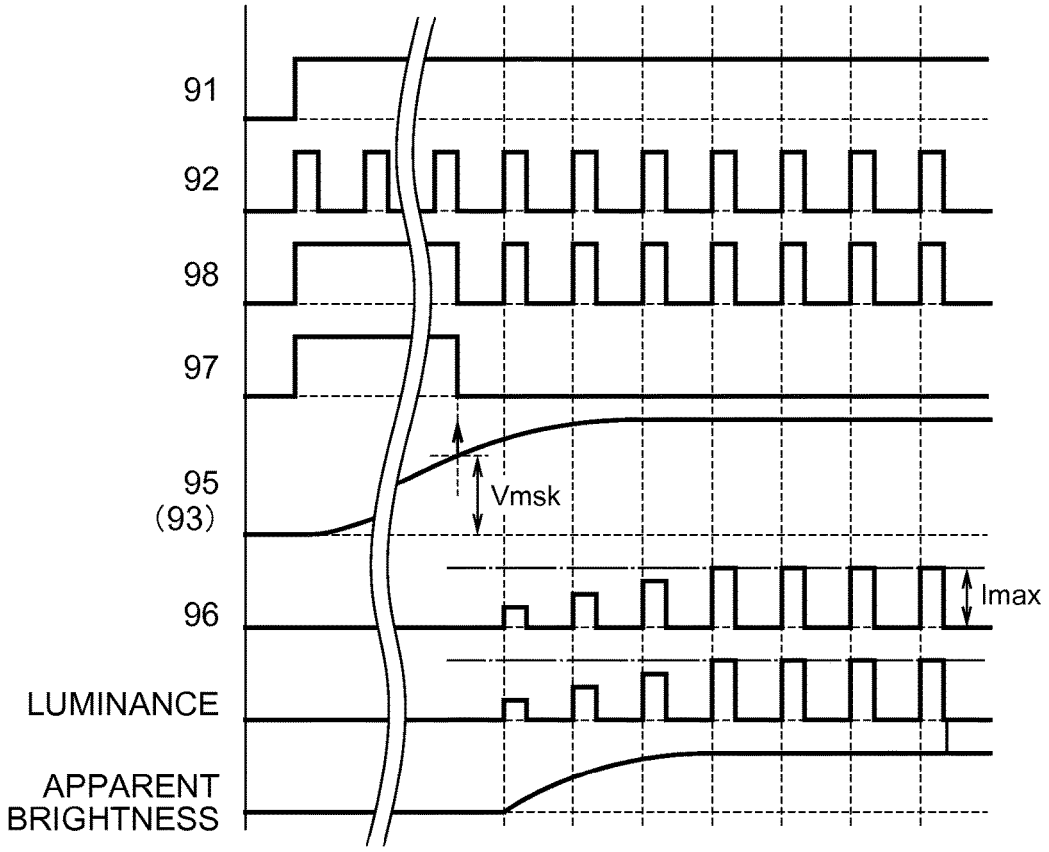
FIG. 3 is a time chart showing the state of signals and the like transmitted and received by the LED driving circuit disclosed in FIG. 1.

As shown in FIG. 3, the PWM signal having 100% duty ratio (Duty 100%) is employed as the duty control signal 97 generated by the voltage monitoring circuit unit 51 in the adjusting period (the adjusting signal 98 generated by the duty ratio adjusting circuit unit 41).

When the power supply voltage 91 showing a specific voltage value and the PWM dimming signal 92 showing a rectangular pulse waveform are inputted from outside (when the power is supplied), the voltage monitoring circuit unit 51 starts continuous monitoring of the anode voltage 93 and transmits the duty control signal 97 having a larger duty ratio than that of the PWM dimming signal 92 to the duty ratio adjusting circuit unit 41 since the anode voltage 93 has not reached the threshold voltage (Vmsk).

The duty ratio adjusting circuit unit 41 upon receiving it generates the adjusting signal 98 (Hi adjusting signal) acquired by synchronizing the duty control signal 97 with the PWM dimming signal 92, and transmits it from the output end (DUTY-out).

As shown in FIG. 3, the first exemplary embodiment employs the structure with which: the voltage monitoring circuit unit 51 transmits the duty control signal 97 having 100% duty ratio to the duty ratio adjusting circuit unit 41; and the duty ratio adjusting circuit unit 41 which has generated the adjusting signal 98 having 100% duty ratio acquired by synchronizing the duty control signal 97 with the PWM dimming signal 92 transmits it to the booster circuit unit 20 and the constant current circuit unit 30 from the output end (DUTY-out).

That is, the voltage monitoring circuit unit 51 having a function of judging whether or not the anode voltage 93 has reached the threshold voltage (Vmsk) is structured to transmit the duty control signal 97 of 100% duty ratio during the period (the adjusting period) until the anode voltage 93 (VF95) reaches the threshold voltage (Vmsk). The duty ratio adjusting circuit unit 41 that receives it also employs the structure which transmits the adjusting signal 98 of 100% duty ratio.

During the period where the Hi adjusting signal is being inputted from the duty ratio adjusting circuit unit 41, the booster circuit unit 20 continuously executes the boosting operations based thereupon. Thus, it is possible to increase the VF95 that is the forward voltage between the anode and the cathode more quickly than a normal case.

That is, as shown in FIG. 3, the booster circuit unit 20 according to the first exemplary embodiment is structured to execute the boosting operations based on the control signal having 100% duty ratio and not to execute intermittent operations.

Then, the voltage monitoring circuit unit 51 is structured to start and continue transmission of the duty control signal 97 having 0% duty ratio when the VF95 reaches the threshold voltage (Vmsk).

Note here that the duty control signal 97 of 0% duty ratio which is transmitted by the voltage monitoring circuit unit 51 at the instant when the VF95 reaches the threshold voltage (Vmsk) is specifically referred to as a Vmsk signal.

When the VF95 reaches the threshold voltage (Vmsk), the duty ratio adjusting circuit unit 41 upon receiving the Vmsk signal from the voltage monitoring circuit unit 51 transmits the adjusting signal 98 of the same duty ratio as that of the PWM dimming signal 92 thereafter, and the booster circuit 20 boosts up the VF95 based thereupon.

That is, when the LED group 80A starts to light up, the luminance is controlled by the adjusting signal 98 based on the PWM dimming signal 92.

Note here that the operation after the VF95 reaches the threshold voltage (Vmsk) is referred to as a normal operation, and the period where the normal operation is executed is referred to as a normal operation period.

When the electric current starts to flow in the constant current circuit 30, i.e., when the LED current 96 starts to flow therein, and the LED current 96 is increased in accordance with the increase of the VF95 as shown in FIG. 3, the luminance of the LED and the apparent brightness of the LED are designed to increase accordingly.

Thereafter, when the LED current 96 reaches the normal operation current Imax, the stable light-up state of the LED group 80A is maintained.

(Explanations of Operations)

Operations regarding the LED driving circuit 11 disclosed in FIG. 1 will be described by referring to a flowchart shown in FIG. 4. Here, the operation contents regarding the voltage monitoring circuit unit 51 and the duty ratio adjusting circuit unit 41 will be described in particular.

Figure 4:
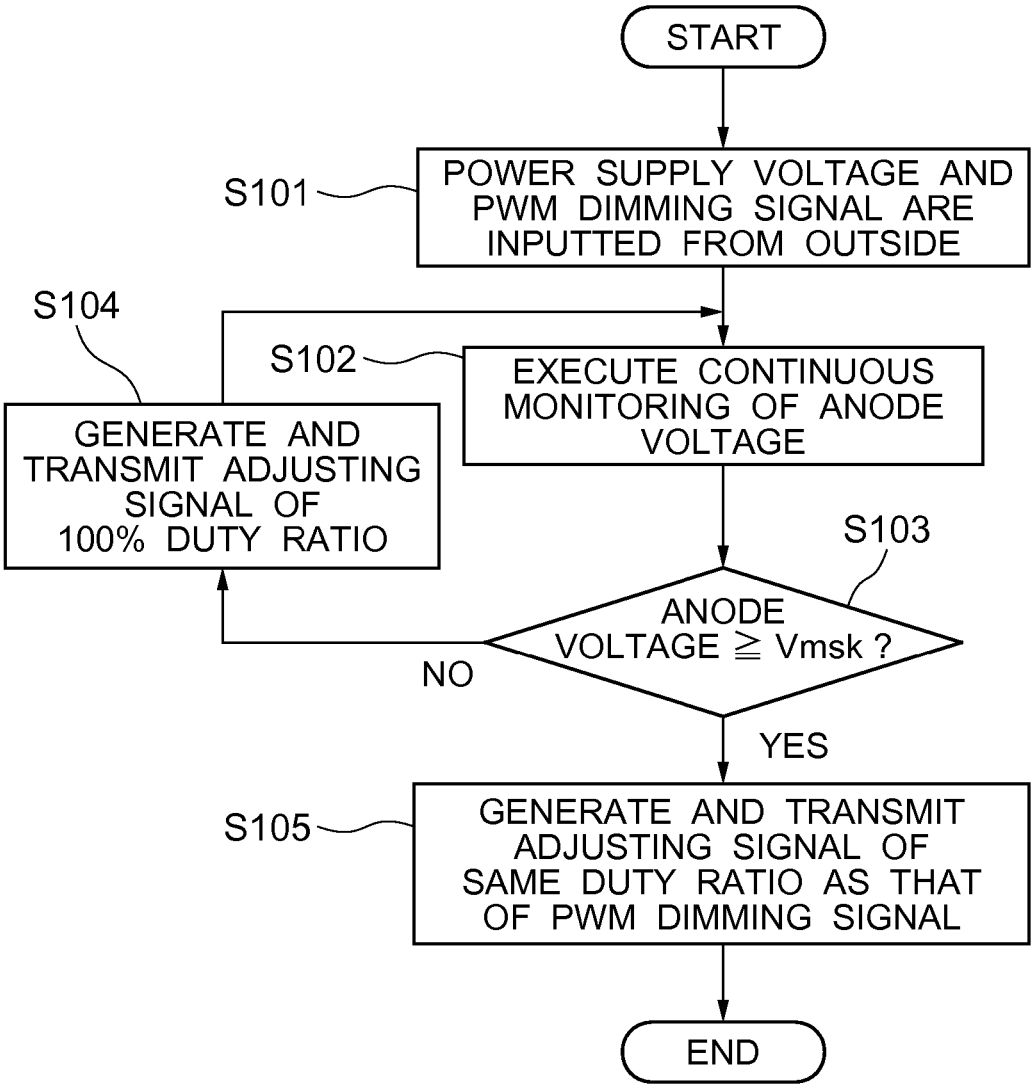
FIG. 4 is a flowchart showing operations of the LED driving circuit disclosed in FIG. 1.

When the power supply voltage 91 and the PWM dimming signal 92 are inputted, i.e., when the power is supplied (FIG. 4: S101), the voltage monitoring circuit unit 51 starts continuous monitoring of the anode voltage 93 (FIG. 4: S102).

That is, thereafter, the voltage monitoring circuit unit 51 performs time-course voltage monitoring and judges whether or not the anode voltage 93 has reached the threshold voltage (Vmsk) (FIG. 4: S103).

Here, the voltage monitoring circuit 51 during the period (the adjusting period) until the anode voltage 93 reaches the threshold voltage (Vmsk) (FIG. 4: S103/No) transmits the duty control signal 97 of 100% duty ratio. The duty ratio adjusting circuit unit 41 upon receiving it generates the adjusting signal 98 which is of 100% duty ratio also and is synchronized with the PWM dimming signal 92, and transmits it to the booster circuit unit 20 and the constant current circuit unit 30 (FIG. 4: S104).

Then, the voltage monitoring circuit unit 51 performs continuous monitoring of the anode voltage 93 and continuously executes judgment regarding whether or not it has reached the threshold voltage (Vmsk) (FIG. 4: S102, S103).

In the meantime, the voltage monitoring circuit unit 51 after the anode voltage reaches the threshold voltage (Vmsk) (FIG. 4: S103/Yes) transmits the duty control signal 97 having 0% duty ratio. The duty ratio adjusting circuit unit 41 upon receiving it generates the adjusting signal 98 which is of the duty ratio equivalent to that of the PWM dimming signal 92 and is synchronized with the PWM dimming signal 92, and transmits it to the booster circuit unit 20 and the constant current circuit unit 30 (FIG. 4: S105).

The booster circuit unit 20 that has received the adjusting signal 98 from the duty ratio adjusting circuit unit 41 through the above (FIG. 4: S104, S105) boosts up the VF95 that is the forward voltage between the anode and the cathode based thereupon.

A part of or a whole part of the execution content in each of the steps S101 to S105 (FIG. 4) may be put into programs and the series of each of the control programs may be structured to be executed by a computer.

(Effects and the Like of First Exemplary Embodiment)

The first exemplary embodiment employs the structure with which the drive is started according to the adjusting signal 98 having the duty ratio whose ON period is longer than that of the PWM dimming signal 92 that is used when driving the LED circuit 80 at the time of starting up the power supply voltage. Thus, the time for the VF95 to reach the voltage value required for lighting up the LED group 80A is shortened by the boosting operation of the booster circuit unit 20 based thereupon, so that the time required for lighting up the LED group 80A can be shortened.

Further, the boosting operations are performed based on the PWM signal having a specific duty ratio set in advance at the time of supplying the power regardless of the value of the duty ratio of the PWM dimming signal 92, so that the condition of the start-up time can be maintained almost uniform. This makes it possible to stabilize the initial operation.

Furthermore, since the duty ratio adjusting circuit unit 41 and the voltage monitoring circuit unit 51 provided in the previous stage of the LED driving circuit 11 according to the first exemplary embodiment execute the significant duty control based on the monitoring result of the anode voltage 93, the circuit structure that does not depend on the power load of the LED circuit 80 can be maintained. That is, the structural members of the first exemplary embodiment can be easily added to the existing circuit, and it is possible to implement the common-use of the circuit regardless of the number of LEDs provided to the existing LED backlight.

Further, the LED circuit 80 is structured mainly with the LEDs alone, so that the booster circuit unit 20 and the constant current circuit unit 30 do not need to drive the load other than the LEDs such as the bypass circuit of the related technique described above. Thus, it is possible to suppress generation of the extra power.

Furthermore, since the voltage monitoring circuit unit 51 which performs continuous monitoring (24-hour monitoring) of the anode voltage 93 of the LED circuit 80 is employed, it is possible to perform a significant constant operation within the period until the LED is lighted up even when there is a change generated in the boost-up time caused due to the temperature environment, the rise condition of the power supply voltage, variations in the characteristics of the peripheral circuits, or the like.

Further, the LED driving circuit according to the first exemplary embodiment is particularly associated with the boosting operation before the LED is lighted up. Thus, the time required until the LED is lighted up can be shortened and stabilized without causing inconvenience that leads to display quality deterioration such as brightening, flashing, or the like of the display screen generated only momentarily at the time of starting the light-up.

Further, the duty ratio of the PWM signals (the duty control signal 97, the adjusting signal 98) in the period (the adjusting period) until the duty ratio adjusting circuit unit 41 receives the Vmsk signal from the voltage monitoring circuit unit 51 may be set arbitrarily.

That is, for example, in a case where it is desired to start up the LED circuit 80 slowly, in a case where it is desired to have differences in the start-up time of each system in the liquid crystal display device which includes the LED circuit having the anode of two or more systems, a case where it is desired to start up each of the systems simultaneously, etc., the PWM signals having arbitrarily set periods and duty ratios according to the light-up time of the backlight required for the liquid crystal display device may be used.

As an exemplary advantage according to the invention, the present invention specifically makes it possible to provide the LED driving circuit, the LED driving method, and the liquid crystal display device capable of preventing deterioration of the display quality such as flicker through effectively shortening the time required for starting up the LED backlight and stabilizing the driving operations thereof.

Second Exemplary Embodiment

A second exemplary embodiment of the LED driving circuit and the LED lighting device 102 provided to the liquid crystal display device according to the present invention will be described by referring to FIG. 5 to FIG. 7. The same reference numerals are used for the structural members same as those of the above-described first exemplary embodiment.

(Overall Structures)

Figure 5:
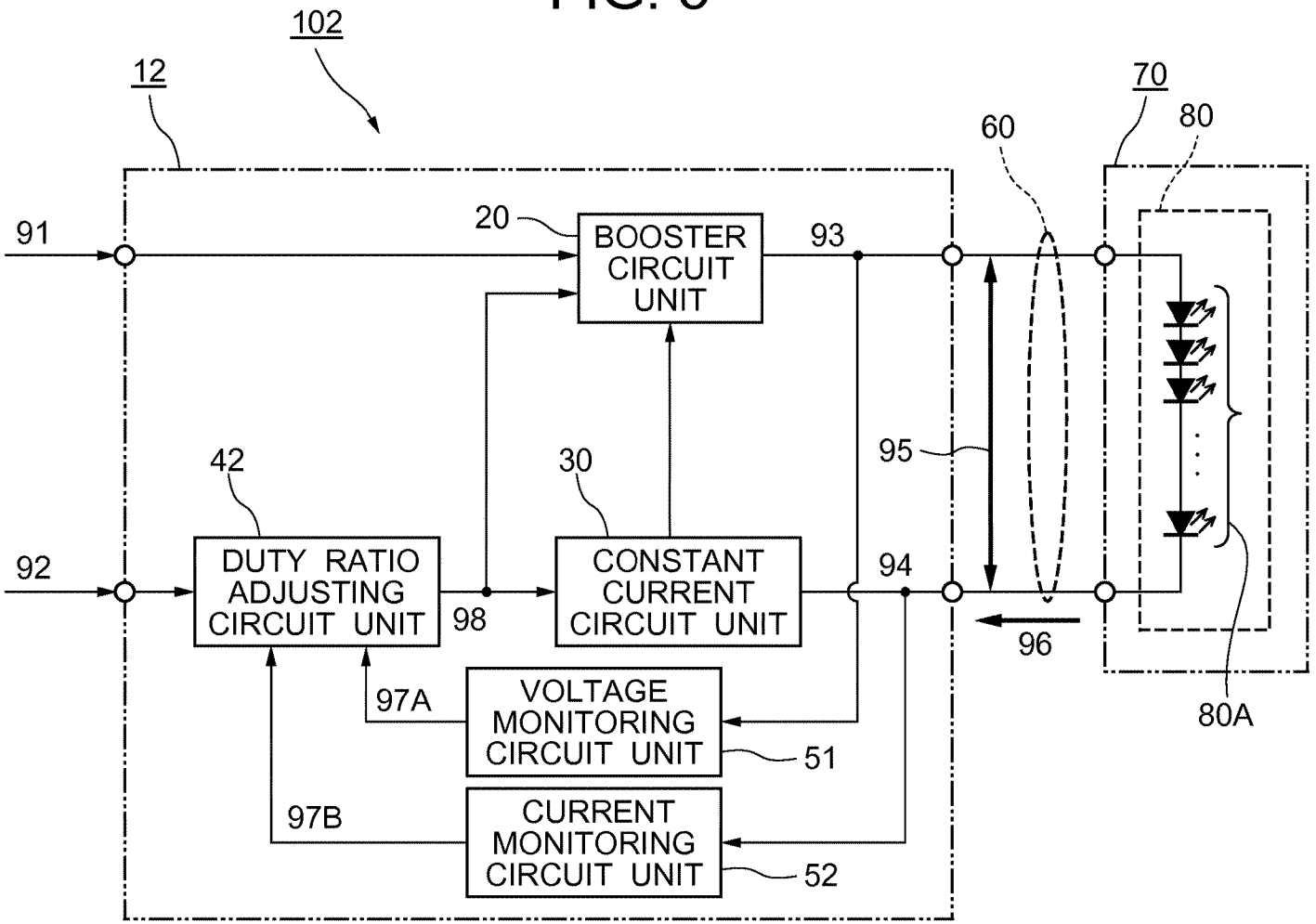
FIG. 5 is a block diagram showing an LED driving circuit according to a second exemplary embodiment of the present invention and the peripheral structure thereof.

As shown in FIG. 5, an LED driving circuit 12 according to the second exemplary embodiment employs the structure that includes a current monitoring circuit unit 52 which monitors the LED current 96 (forward electric current) flown out from the cathode side of the LED circuit 80 of the first exemplary embodiment described above and transmits a signal (a second duty control signal 97B) based on the monitored current to a duty ratio adjusting circuit unit 42.

Further, for convenience, the signal transmitted by the voltage monitoring circuit unit 51 that is in the same structure as that of the first exemplary embodiment described above to the duty ratio adjusting circuit unit 42 based on the monitoring result of the anode voltage 93 is referred to as a first duty control signal 97A.

That is, the duty ratio adjusting circuit unit 42 is structured to generate the adjusting signal 98 synchronized with the PWM dimming signal 92 based on the first duty control signal 97A transmitted from the voltage monitoring circuit unit 51 and the second duty control signal 97B transmitted from the current monitoring circuit unit 52, and to transmit it to the booster circuit unit 20 and the constant current circuit unit 30.

Figure 6:
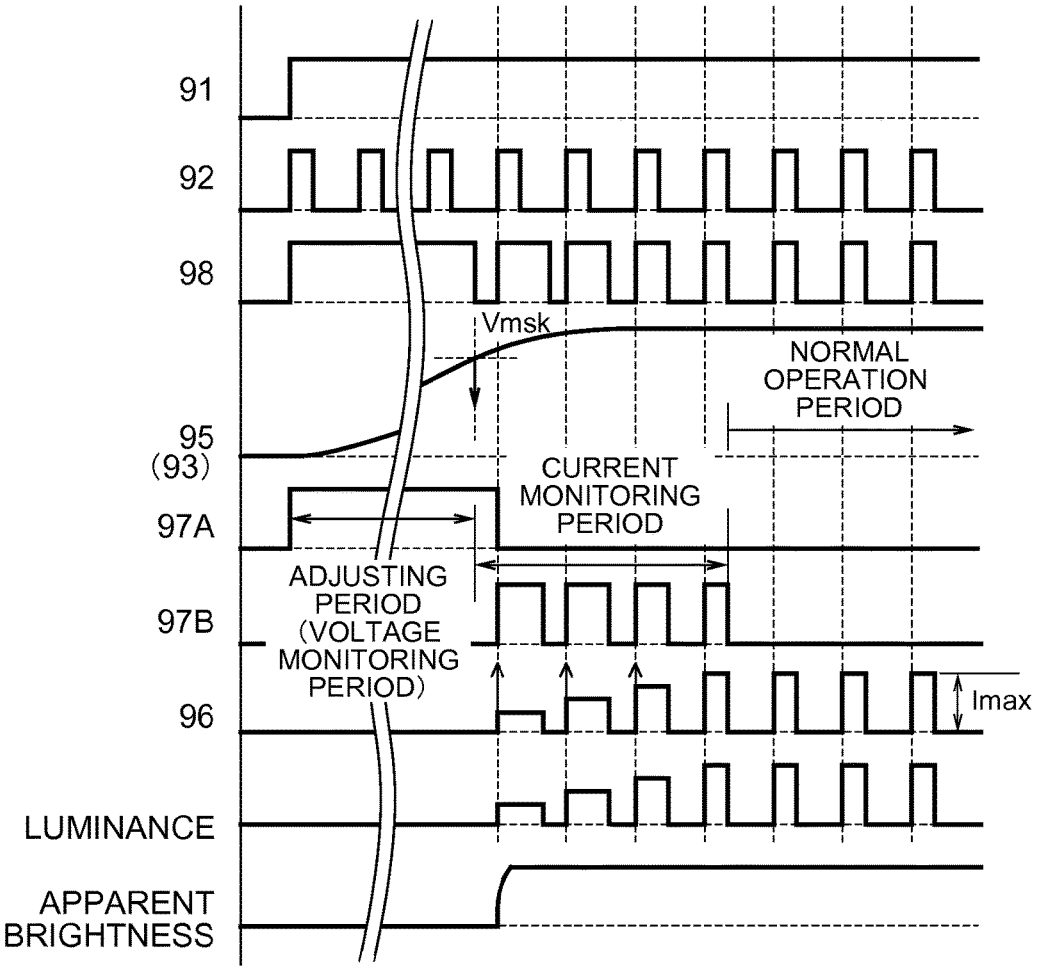
FIG. 6 is a time chart showing the state of signals and the like transmitted and received by the LED driving circuit disclosed in FIG. 5.

More specifically, as shown in FIG. 6, drive control of the LED circuit 80 based on a specific duty ratio set arbitrarily is executed as in the case of the first exemplary embodiment described above based on the result of continuous monitoring done by the voltage monitoring circuit unit 51 during the period (adjusting period: voltage monitoring period) until the VF95 reaches the threshold voltage (Vmsk), and the current monitoring circuit unit 52 executes continuous monitoring of the LED current 96 (current value) within a specific period (current monitoring period) from the point immediately after the VF95 reaches the threshold voltage (Vmsk).

That is, the current monitoring circuit unit 52 is structured to execute continuous monitoring of the current value continuously in the period until the LED current 96 reaches Imax that is a normal operation current value (the current monitoring period) and to transmit the second duty control signal 97B whose pulse width is arbitrarily adjusted based on the monitoring result to the duty ratio adjusting circuit unit 42.

The booster circuit unit 20 that has acquired the adjusting signal 98 generated based on the second duty control signal 97B from the duty ratio adjusting circuit unit 42 is structured to perform boosting operations of the VF95 based thereupon. Thus, the apparent brightness at the light-up timing of the LED can be controlled arbitrarily.

As shown in FIG. 6, the second exemplary embodiment employs a method which irregularly changes the duty ratio (the output current pulse width) when the current monitoring circuit unit 52 generates the second duty control signal 97B in accordance with the value of the LED current 96.

That is, the duty ratio adjusting circuit unit 42 which is structured to adjust the output current pulse width of the adjusting signal 98 according to the second duty control signal 97B transmitted from the current monitoring circuit unit 52 employs the structure which brings the duty ratio (the output current pulse width) of the adjusting signal 98 close to the duty ratio of the PWM dimming signal 92 by gradually decreasing it within a specific period immediately after the forward electric current monitored by the current monitoring circuit unit 52 starts to flow.

More specifically, the current monitoring circuit unit 52 employs the structure which increases the duty ratio when the difference between the LED current 96 and Imax is large, and gradually changes it to be close to the duty ratio of the normal operation as the difference becomes smaller (when the LED current 96 becomes closer to Imax) to generate and output the second duty control signal 97B.

This makes it possible to make the apparent brightness uniform and to lighten the change in the brightness, so that the deterioration in the display quality can be prevented. Furthermore, the time required for acquiring prescribed luminance can be shortened.

Further, the LED driving circuit 12 according to the second exemplary embodiment is also structured to execute the normal operation same as that of the LED driving circuit 11 according to the first exemplary embodiment described above in a normal operation period that is the period after the LED current 96 reaches Imax that is the normal operation current value. Other structural contents are the same as the structural members of the LED driving circuit 11 according to the first exemplary embodiment described above.

(Explanations of Operations)

Operations regarding the LED driving circuit 12 disclosed in FIG. 5 will be described by referring to a flowchart shown in FIG. 7. Here, the operation contents regarding the voltage monitoring circuit unit 51, the current monitoring circuit unit 52, and the duty ratio adjusting circuit unit 42 will be described in particular.

Figure 7:
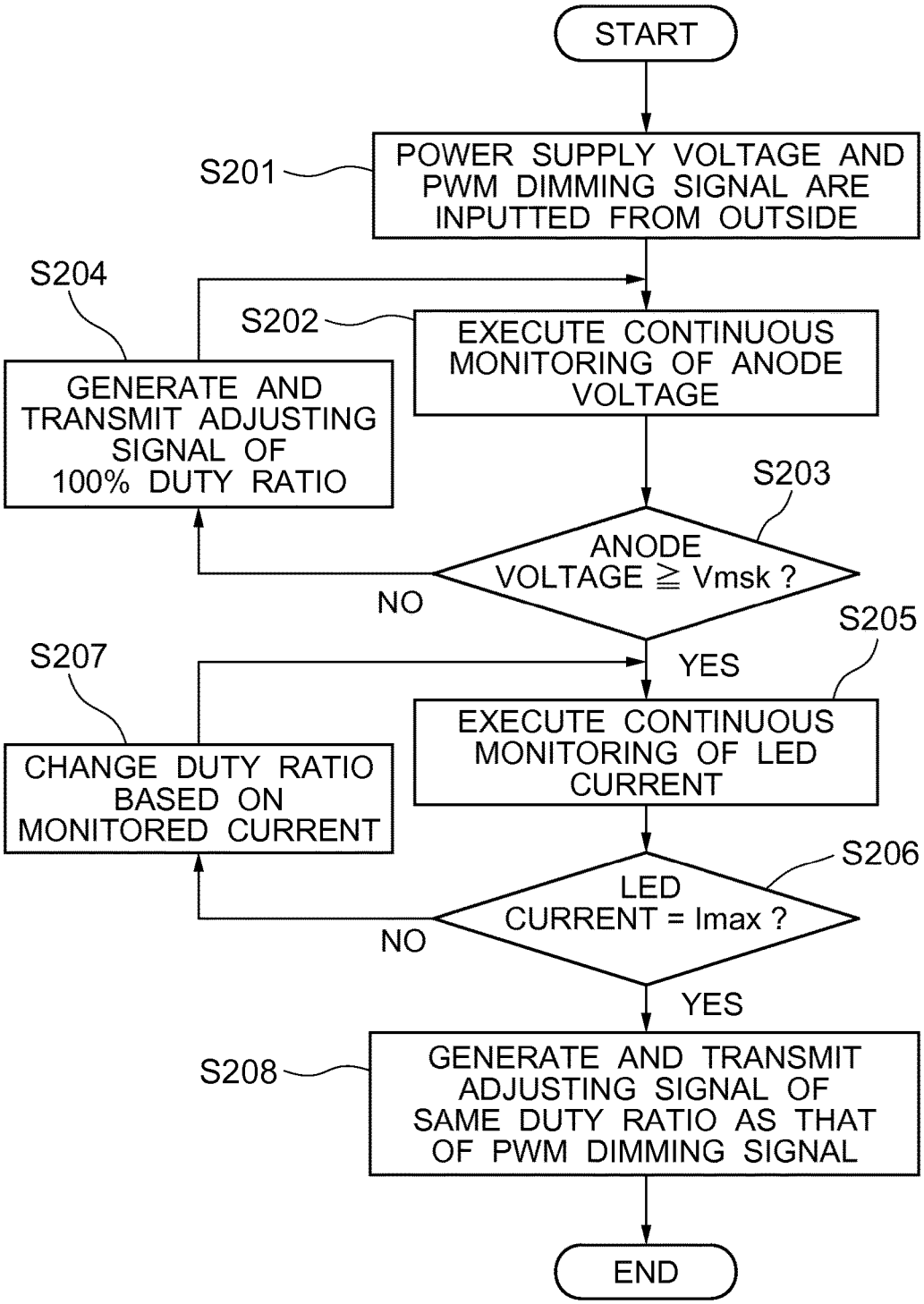
FIG. 7 is a flowchart showing operations of the LED driving circuit disclosed in FIG. 5.

When the power supply voltage 91 and the PWM dimming signal 92 are inputted (FIG. 7: S201), the voltage monitoring circuit unit 51 starts continuous monitoring of the anode voltage 93 (FIG. 7: S202).

The voltage monitoring circuit 51 during the period (the adjusting period) until the anode voltage 93 reaches the threshold voltage (Vmsk) (FIG. 7: S203/No) transmits the first duty control signal 97A of 100% duty ratio. The duty ratio adjusting circuit unit 42 upon receiving it generates the adjusting signal 98 which is of 100% duty ratio also and is synchronized with the PWM dimming signal 92, and transmits it to the booster circuit unit 20 and the constant current circuit unit 30 (FIG. 7: S204).

Then, the voltage monitoring circuit unit 51 performs continuous monitoring of the anode voltage 93 and continuously executes judgment regarding whether or not it has reached the threshold voltage (Vmsk) (FIG. 7: S202, S203).

In the meantime, when the anode voltage 93 reaches the threshold voltage (Vmsk) (FIG. 7: S203/Yes), the current monitoring circuit unit 52 starts continuous monitoring of the LED current 96 (FIG. 7: S205).

When monitoring the electric current, the current monitoring circuit unit 52 judges whether or not the LED current 96 is equivalent to Imax that is the normal operation current (FIG. 7: S206).

That is, during a period where the LED current 96 is smaller than Imax (FIG. 7: S206/No), the current monitoring circuit unit 52 generates and transmits the second duty control signal 97B whose duty ratio is changed in accordance with the value of the LED current 96 acquired by the monitoring. The duty ratio adjusting circuit unit 42 upon receiving it transmits the adjusting signal 98 acquired by synthesizing the second duty control signal 97B with the PWM dimming signal 92 to the booster circuit unit 20 and the constant current circuit unit 30 (FIG. 7: S207).

In the meantime, when the LED current 96 reaches Imax (FIG. 7: S206/Yes), the current monitoring circuit unit 52 thereafter transmits the second duty control signal 97B of 0% duty ratio. The duty ratio adjusting circuit unit 42 upon receiving it generates the adjusting signal 98 which is of the equivalent duty ratio as that of the PWM dimming signal 92 and is synthesized with the PWM dimming signal 92 to the booster circuit unit 20 and the constant current circuit unit 30 (FIG. 7: S208).

The booster circuit unit 20 that has received the adjusting signal 98 from the duty ratio adjusting circuit unit 42 through the above (FIG. 7: S204, S207, S208) boosts up the VF95 that is the forward voltage between the anode and the cathode.

A part of or a whole part of the execution content in each of the steps S201 to S208 (FIG. 7) may be put into programs and the series of each of the control programs may be structured to be executed by a computer.

(Effects and the Like of Second Exemplary Embodiment)

The second exemplary embodiment employs the current monitoring circuit unit 52 which monitors the LED current 96 flown out from the cathode side of the LED circuit 80 and employs the structure with which the current monitoring circuit unit 52 generates the second duty control signal 97B by corresponding to the difference between the LED current 96 and Imax that is the normal operation current and the booster circuit unit 20 executes the boosting operation according to the adjusting signal 98 generated based thereupon. Thereby, the driving operations of the LED circuit 80 can be stabilized. Therefore, there is no sense of uncomfortableness felt thereby, so that it is possible to prevent deterioration of the display quality by lightening the change in the brightness and flicker.

Further, as the PWM control in the above-described current monitoring period, employed is the structure with which the current monitoring circuit unit 52 monitors the electric current and executes the control according to the monitoring result. However, it is also possible to employ a structure with which the current monitoring circuit unit is not employed in a specific period from the point immediately after reaching the threshold voltage Vmsk and the duty ratio is simply changed in a gradual manner (step by step) from high values to low values.

That is, it is also possible to employ a structure with which the duty ratio adjusting circuit unit 42 brings the duty ratio of the adjusting signal 98 close to the duty ratio of the PWM dimming signal 92 through gradually decreasing it within a specific period immediately after the anode voltage monitored by the voltage monitoring circuit unit 51 reaches the threshold voltage.

With this, it is also possible to lighten the change in the apparent luminance and further to shorten the time required until reaching the prescribed luminance. Moreover, with this structure, the current monitoring circuit unit 52 becomes unnecessary, so that the structure can be simplified.

Further, through setting an arbitrary duty ratio different from that of the PWM dimming signal 92 in advance, it is also possible to employ a structure for achieving a specific control in a specific period such as controlling the drive of the LED circuit 80 based on the PWM signal having the set duty ratio during a period where the LED current 96 started to flow is lower than Imax.

Other effects and the like are same as those of the first exemplary embodiment described above.

Third Exemplary Embodiment

A third exemplary embodiment of the LED driving circuit and the liquid crystal display device according to the present invention will be described by referring to FIG. 8 and FIG. 9. The same reference numerals are used for the structural members same as those of the above-described first and second exemplary embodiments.

(Overall Structures)

Figure 8:
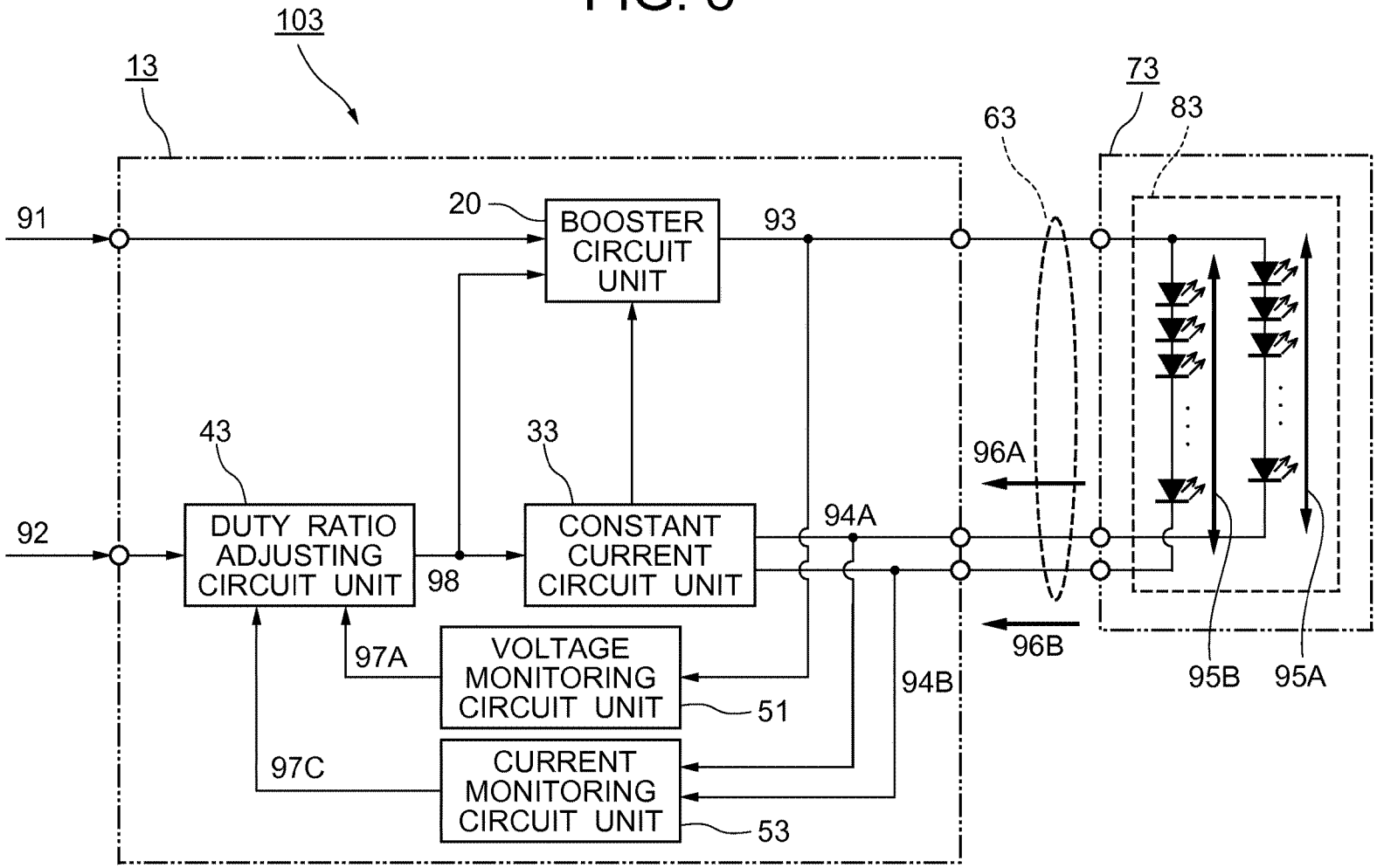
FIG. 8 is a block diagram showing an LED driving circuit according to a third exemplary embodiment of the present invention and the peripheral structure thereof.

As shown in FIG. 8, the third exemplary embodiment employs an LED circuit 83 which includes two or more systems of LED groups constituted in such a manner that the anode voltage is used in common instead of the LED circuit 80 employed in the first and second exemplary embodiments described above. For convenience, FIG. 8 shows a case of providing two systems of LED groups.

As the LED group in this case, it is also possible to employ a structure in which a plurality of LEDs are connected in series or connected in parallel, a structure in which a serial connection and a parallel connection are combined variously, etc., as in the case of the LED group 80A of the first and second exemplary embodiments described above. Understandably, it is also possible to employ a single LED instead of the LED group 80A.

That is, the LED lighting device 103 provided to the liquid crystal display device according to the third exemplary embodiment includes: a backlight 73 equipped with the LED circuit 83 that is constituted by containing one LED or two or more LEDs; and an LED driving circuit 13 which drives the LED circuit 83 by using the power supply voltage 91 and the PWM dimming signal 92 inputted from outside. The LED circuit 83 includes the two or more systems of LED groups using the same anode voltage, which are connected in series, in parallel, or a combination thereof.

A current monitoring circuit unit 53 includes an each-system monitoring processing module (not shown) which monitors each forward electric current (the first LED current 96A, the second LED current 96B) flown from the cathode side of each of the LED groups immediately after the anode voltage 93 monitored by the voltage monitoring circuit unit 51 reaches the threshold voltage (Vmsk) and transmits the signal (the second duty control signal 97C) based on each of the monitored currents to the duty ratio adjusting circuit unit 43.

The duty ratio adjusting circuit unit 43 employs the structure which adjusts the output current pulse width of the adjusting signal in accordance with the signal (the second duty control signal 97C) based on each of the monitored currents.

Each of the structures according to the third exemplary embodiments effectively functions particularly when the light-up start timing varies for each system due to variations and the like in the VF characteristics of the LEDs.

That is, with those structures, it is possible to monitor the electric current flown in each system by the current monitoring circuit 53 and to significantly control the duty ratio of the PWM signal regarding the boosting operation in the current monitoring period based on the monitoring result. Therefore, the change in the apparent brightness at the time of starting the light-up can be adjusted more smoothly.

In FIG. 8, the forward voltage showing the potential difference between the anode voltage 93 and a first cathode voltage 94A is expressed as the first VF95A, and the forward voltage showing the potential difference between the anode voltage 93 and a second cathode voltage 94B is expressed as a second VF95B. In the third exemplary embodiment, those are shown in the time chart of FIG. 9 on an assumption that the anode voltage 93, the first VF95A, and the second VF95B are structured to have a common voltage value.

Figure 9:
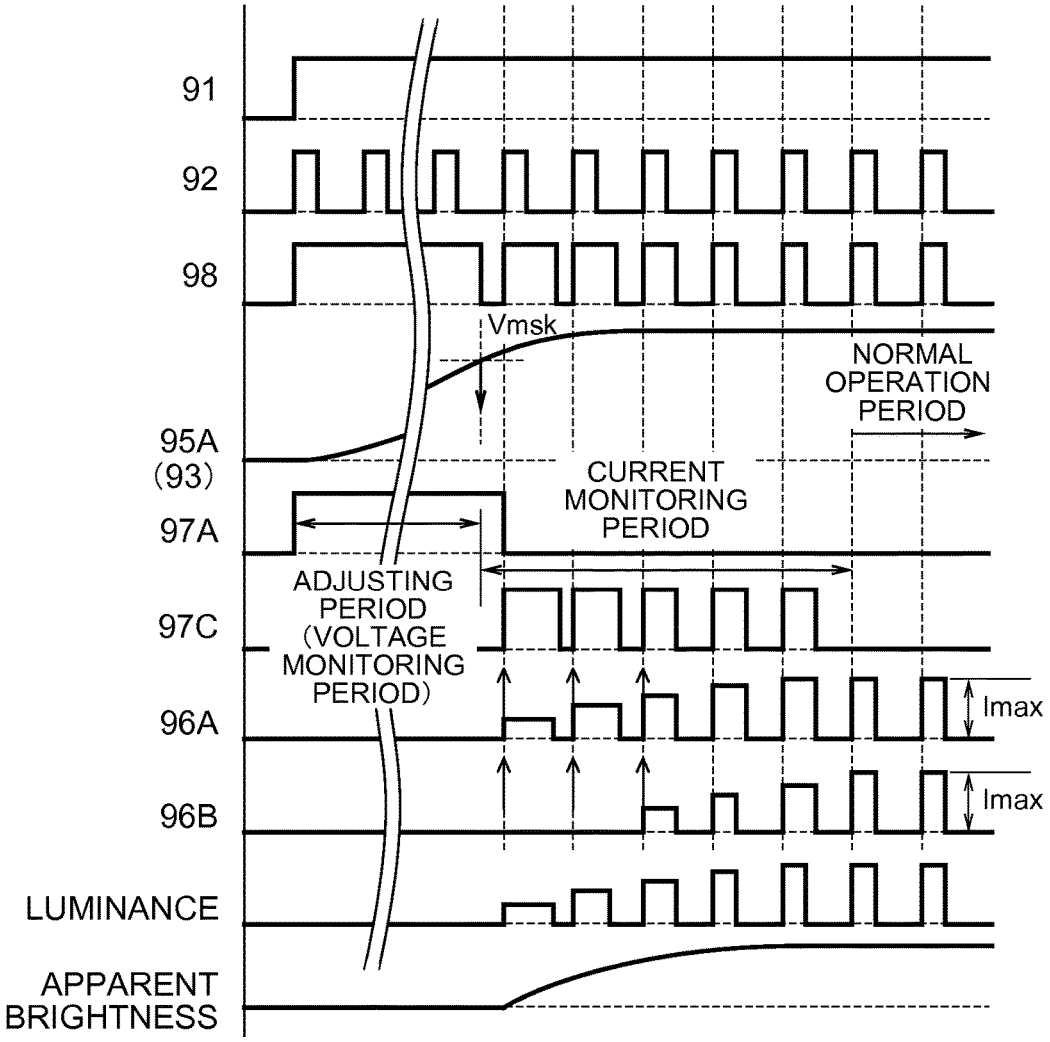
FIG. 9 is a time chart showing the state of signals and the like transmitted and received by the LED driving circuit disclosed in FIG. 8.

As shown in the time chart of FIG. 9, the duty ratio of the second duty control signal 97C is increased during a period when only the first LED current 96A is flown, while it is lowered immediately after the second LED current 96B starts to flow. Thereby, the apparent brightness at the time of starting the light-up can be made uniform.

The LED driving circuit 13 according to the third exemplary embodiment is also structured to execute the normal operation same as that of the LED driving circuit 11 of the first exemplary embodiment described above in the normal operation period after the period (the current monitoring period) until both of the first LED current 96A and the second LED current 96B reach Imax that is the normal operation current.

Other structural contents are same as each of the structural members of the first and second exemplary embodiments described above.

(Effects and the Like of Third Exemplary Embodiment)

The current monitoring circuit unit 53 which individually monitors each current flown out from the two or more systems of LED groups and adjusts the duty ratio of the second duty control signal transmitted to the duty ratio adjusting circuit unit 43 according to the monitoring results of those is provided, so that the apparent brightness at the time of starting the light-up can be made more uniform.

Further, the constant current circuit 33 may employ a structure which performs duty control for each system. This makes it possible to change the duty ratio in the current monitoring period for each system, so that the apparent brightness can be made uniform with higher precision.

The operation contents of the third exemplary embodiment are the same as the contents that are described in the second exemplary embodiment by referring to FIG. 7.

Other effects and the like are the same as those of the first and second exemplary embodiments described above.

Fourth Exemplary Embodiment

A fourth exemplary embodiment of the LED driving circuit and the LED lighting device 104 provided to the liquid crystal display device according to the present invention will be described by referring to FIG. 10 to FIG. 12. The same reference numerals are used for the structural members same as those of the above-described first to third exemplary embodiments.

(Overall Structures)

The fourth exemplary embodiment employs a duty ratio adjusting circuit unit 44 which calculates and sets the adjusting period (the duty adjusting period: T1) based on the PWM dimming signal 92 and the operation characteristic information of the booster circuit unit 20 instead of the duty ratio adjusting circuit unit 41 of the first exemplary embodiment described above.

Figure 10:
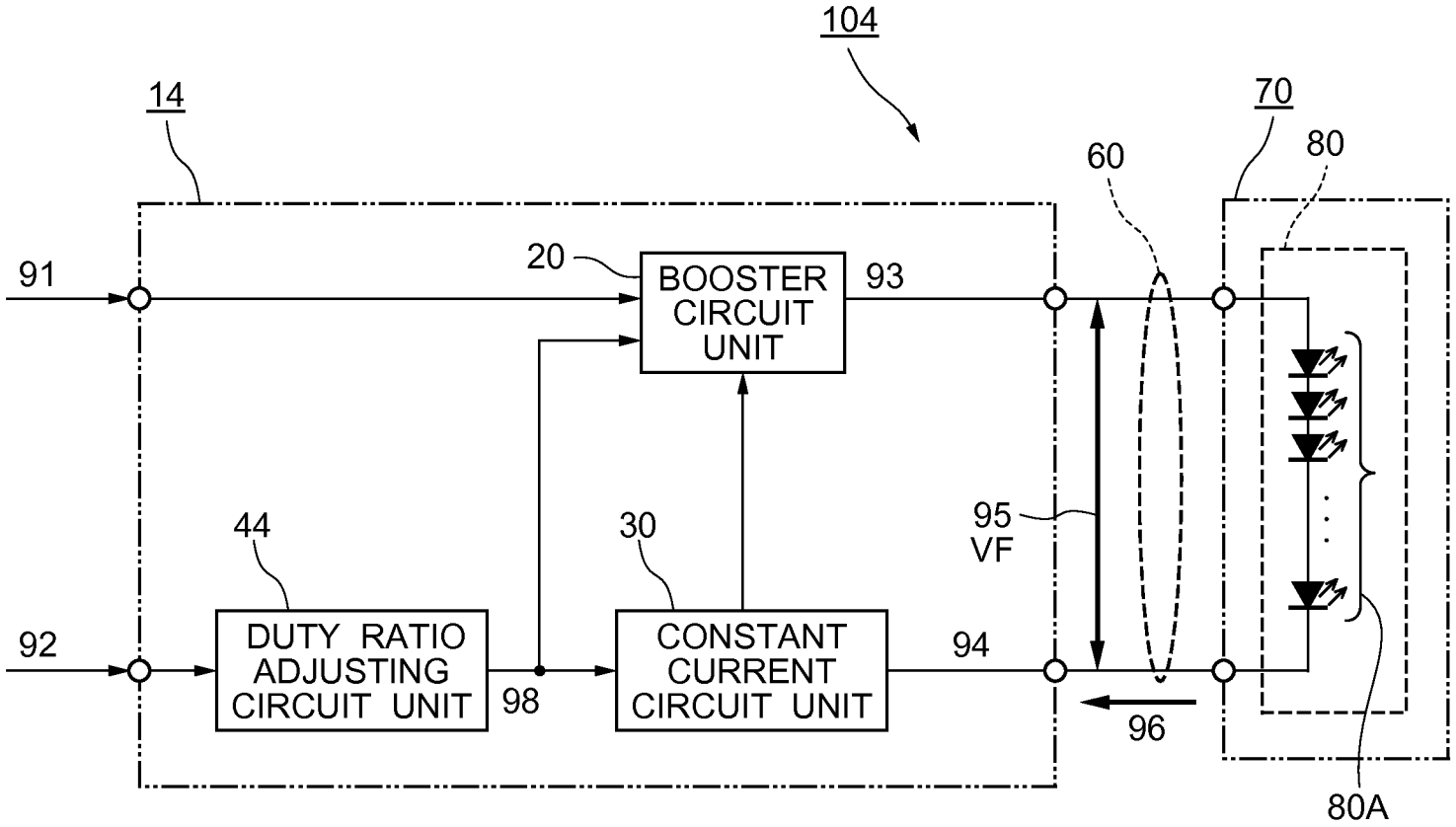
FIG. 10 is a block diagram showing an LED driving circuit according to a fourth exemplary embodiment of the present invention and the peripheral structure thereof.

Therefore, as shown in FIG. 10, it is possible to set the adjusting period (T1: see FIG. 11) which is a specific period immediately after the power is supplied without providing the voltage monitoring circuit unit 51 which monitors the anode voltage 93 and generates/transmits the signals based on the monitoring result. In the adjusting period (T1), drive control of the LED circuit 80 based on an arbitrarily set duty ratio can be performed.

Note here that the adjusting period (T1) is set to satisfy a following relational expression 1.

The operation start time (A) is the time from the point at which the power is supplied until the point at which the booster circuit 20 starts an operation. The "boosting time when 100% (B)" is the time required for the booster circuit 20 to boost up the VF95 that is the forward voltage of the LED circuit 80 to a prescribed voltage when the duty ratio of the adjusting signal 98 transmitted from the duty ratio adjusting circuit unit 44 is 100%. Further, "PWM-Duty (C)" is the duty ratio of an outside dimming signal.

(Expression 1)

$$\text{Adjusting period}(T1) \geq \text{Operation start time}(A) + \text{Boosting time when } 100\%(B)/\text{PWM-Duty}(C) \quad (1)$$

(A) and (B) in Expression 1 slightly fluctuate depending on the temperature condition, the start-up condition of the power supply voltage, variations generated due to the characteristics of the circuit components.

Thus, the fourth exemplary embodiment employs the structure with which the duty ratio adjusting circuit unit 44 executes, based on the Expression 1, time setting of the adjusting period (T1) according to the PWM-Duty (C) through storing the values of (A) and (B) which are the operation characteristic information of the booster circuit unit 20 according to the use condition and the like to an inside memory or the like (not shown) in advance.

Therefore, the duty ratio adjusting circuit unit 44 can control the ON period of the adjusting signal 98 in the adjusting period (T1) according to the PWM-Duty (C). Thereby, the start-up time can be shortened than the case of a low duty ratio and the time from the point at which the power supply voltage is started to the point at which the LED is started to light up can be set arbitrarily.

Figure 11:
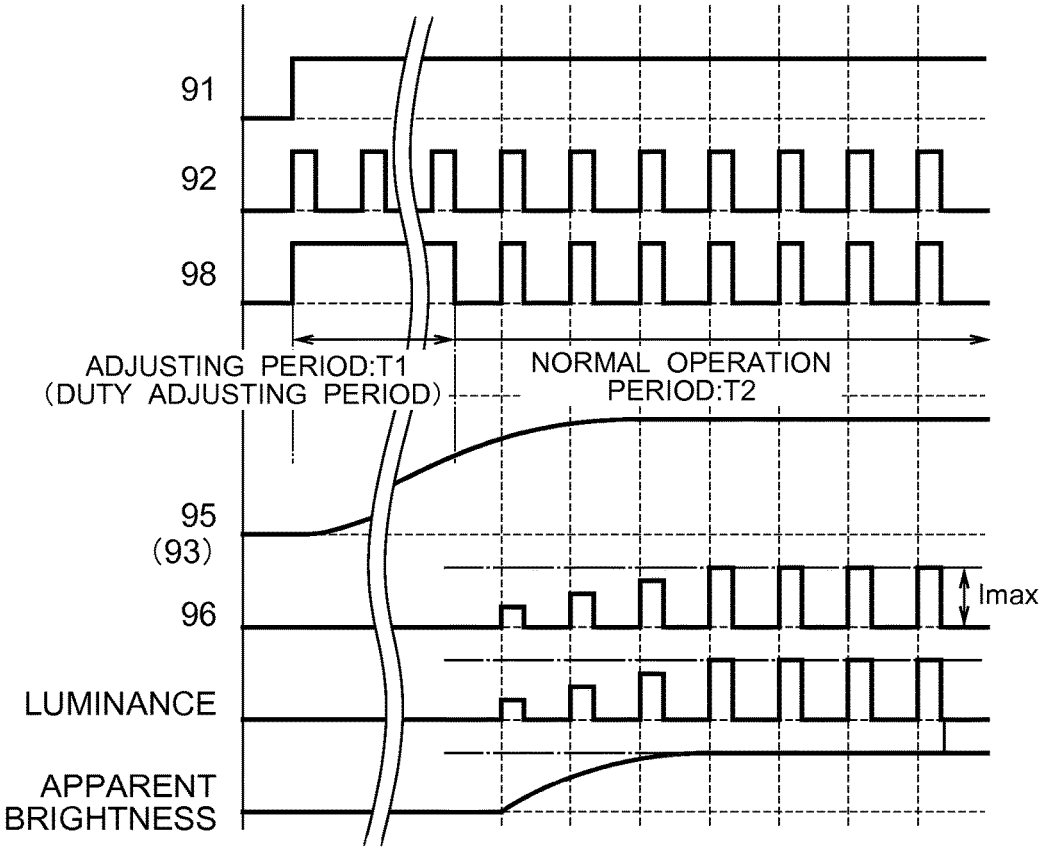
FIG. 11 is a time chart showing the state of signals and the like transmitted and received by the LED driving circuit disclosed in FIG. 10.

An LED driving circuit 14 according to the fourth exemplary embodiment is also structured to execute the normal operation same as that of the LED driving circuit 11 according to the first exemplary embodiment described above in a normal operation period (T2) shown in FIG. 11.

Other structural contents are the same as the structural members according to the first exemplary embodiment described above.

(Explanations of Operations)

Operations regarding the LED driving circuit 14 disclosed in FIG. 10 will be described by referring to a flowchart shown in FIG. 12. Here, the operation contents regarding the duty ratio adjusting circuit unit 44 will be described in particular.

Figure 12:
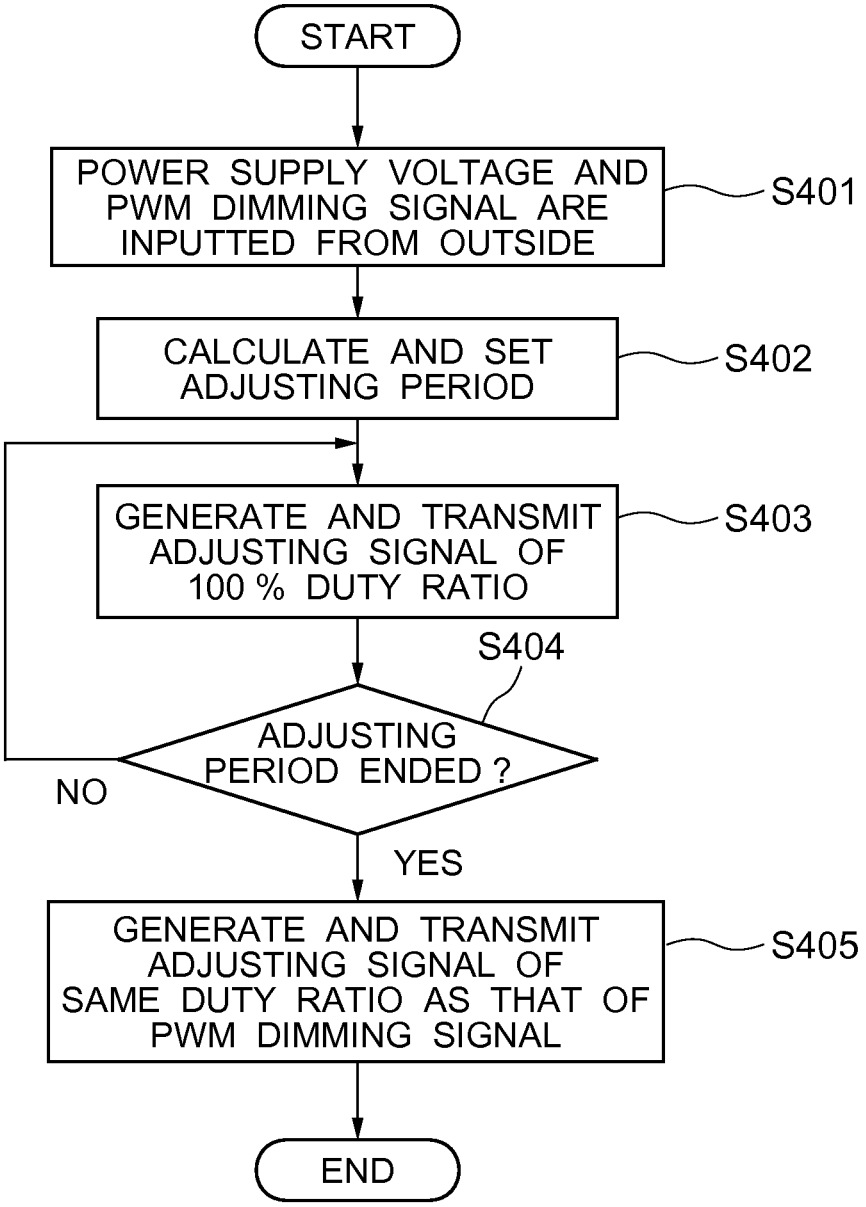
FIG. 12 is a flowchart showing operations of the LED driving circuit disclosed in FIG. 10.

When the power supply voltage 91 and the PWM dimming signal 92 are inputted (FIG. 12: S401), the duty ratio adjusting circuit unit 44 calculates and sets the adjusting period (T1) based on the PWM dimming signal 92 and the operation characteristic information of the booster circuit unit 20 (FIG. 12: S402), and generates and transmits the adjusting signal 98 having a larger duty ratio (100% duty ratio herein) than that of the PWM dimming signal 92 to the booster circuit unit 20 and the constant current circuit unit 30 (FIG. 12: S403).

Further, after the power is supplied, the duty ratio adjusting circuit unit 44 judges whether or not the adjusting period set in the above-described manner has ended (FIG. 12: S404). That is, until the adjusting period (T1) ends (FIG. 12: S404/No), the duty ratio adjusting circuit unit 44 transmits the adjusting signal 98 of 100% duty ratio. After the adjusting period (T1) ends (FIG. 12: S404/Yes), the duty ratio adjusting circuit unit 44 generates and transmits the adjusting signal 98 which is of the duty ratio equivalent to that of the PWM dimming signal 92 and is synchronized with the PWM dimming signal 92 (FIG. 12: S405).

The booster circuit unit 20 that has received the adjusting signal 98 from the duty ratio adjusting circuit unit 44 through the above (FIG. 12: S403, S405) boosts up the VF95 that is the forward voltage between the anode and the cathode.

A part of or a whole part of the execution content in each of the steps S401 to S405 (FIG. 12) may be put into programs and the series of each of the control programs may be structured to be executed by a computer.

(Effects and the Like of Fourth Exemplary Embodiment)

The LED driving circuit 14 according to the fourth exemplary embodiment employs the structure with which the duty ratio adjusting circuit unit 44 calculates/sets the adjusting period (T1) based on the duty ratio of the PWM dimming signal 92 inputted from outside and the operation characteristic information of the booster circuit unit 20 and significantly increases the duty ratio of the adjusting signal 98 in the adjusting period (T1) without providing the voltage monitoring circuit unit 51 which monitors the anode voltage 93. Thus, it is possible to simplify the circuit structure and to quicken the light-up start time of the LED group 80A significantly.

Further, through adjusting the coefficients and the like in Expression 1 described above, the duty ratio adjusting circuit unit 44 can significantly set the adjusting period (T1) which corresponds to the use environment and the like. Thus, it is possible to effectively shorten and stabilize the time required for starting up the LED backlight.

Further, it is also possible to employ the structure with which the adjusting period (T1) inputted from outside is stored to the inside memory or the like and the duty ratio adjusting circuit unit 44 changes the duty ratio of the adjusting signal 98 transmitted to the booster circuit unit 20 and the like based thereupon.

Other structural contents are the same as those of the first exemplary embodiment described above.

Each of the above-described exemplary embodiments shows a preferable specific example of the LED driving circuit, the LED driving method, and the liquid crystal display device, and technically preferable various limitations may be set thereupon. However, it is to be noted that the technical scope of the present invention is not limited to those modes unless there is a specific remark mentioned for limiting the present invention.

New technical contents regarding the above-described exemplary embodiments are summarized as follows. However, the present invention is not necessarily limited thereto.

(Supplementary Note 1)

An LED driving circuit for controlling an LED circuit constituted with one LED or two or more LEDs, the driving circuit includes:

a duty ratio adjusting circuit unit which generates and outputs an adjusting signal for adjusting drive of the LED circuit based on a PWM dimming signal inputted from outside; and a booster circuit unit which applies a driving voltage to the LED circuit according to the adjusting signal outputted from the duty ratio adjusting circuit unit, wherein the duty ratio adjusting circuit unit sets the adjusting signal to have a larger duty ratio than that of the PWM dimming signal within an adjusting period set from a point after a power is supplied to a point at which the LED circuit starts to connect electrically.

(Supplementary Note 2)

The LED driving circuit as depicted in Supplementary Note 1, further includes a voltage monitoring circuit unit which monitors an anode voltage of the LED circuit and outputs a signal based on voltage monitoring to the duty ratio adjusting circuit unit, wherein the adjusting period is a period until the anode voltage monitored by the voltage monitoring circuit unit reaches a threshold voltage that is provided in advance.

(Supplementary Note 3)

The LED driving circuit as depicted in Supplementary Note 2, wherein the duty ratio adjusting control circuit unit generates the adjusting signal by synchronizing the signal based on the voltage monitoring with the PWM dimming signal.

(Supplementary Note 4)

The LED driving circuit as depicted in Supplementary Note 2 or 3, wherein the threshold voltage is set as a smaller value than a voltage required for lighting up all the LEDs constituting the LED circuit.

(Supplementary Note 5)

The LED driving circuit as depicted in Supplementary Note 1, wherein the duty ratio adjusting circuit unit calculates and sets the adjusting period based on the PWM dimming signal and operation characteristic information of the booster circuit unit.

(Supplementary Note 6)

The LED driving circuit as depicted in any one of Supplementary Notes 2 to 4, wherein the duty ratio adjusting circuit unit gradually decreases the duty ratio of the adjusting signal to be generated to bring it close to the duty ratio of the PWM dimming signal within a specific period after the anode voltage monitored by the voltage monitoring circuit unit reaches the threshold voltage.

(Supplementary Note 7)

The LED driving circuit as depicted in any one of Supplementary Notes 1 to 5, further including a current monitoring circuit unit which monitors a forward electric current flown from a cathode side of the LED circuit and outputs a signal based on current monitoring to the duty ratio adjusting circuit unit, wherein the duty ratio adjusting circuit unit adjusts the duty ratio of the adjusting signal according to the signal based on the current monitoring.

(Supplementary Note 8)

The LED driving circuit as depicted in Supplementary Note 7, wherein the duty ratio adjusting circuit unit gradually decreases the duty ratio of the adjusting signal to be generated to bring it close to the duty ratio of the PWM dimming signal within a specific period after the forward electric current monitored by the current monitoring circuit unit starts to flow.

(Supplementary Note 9)

A liquid crystal display device includes:

a liquid crystal display panel which displays a video towards outside;

a backlight which includes an LED circuit constituted with one LED or two or more LEDs and illuminates the liquid crystal panel from a back surface; and the LED driving circuit depicted in Supplementary Notes 1 to 8.

(Supplementary Note 10)

An LED driving method used with an LED driving circuit which includes a booster circuit unit which applies a driving voltage to an LED circuit constituted with one LED or two or more LEDs and a duty ratio adjusting circuit unit which generates and outputs an adjusting signal for adjusting drive of the LED circuit, wherein:

the duty ratio adjusting circuit unit inputs a PWM dimming signal used for controlling operations of the LED circuit from outside;

the duty ratio adjusting circuit unit generates and outputs the adjusting signal having a larger duty ratio than that of the PWM dimming signal within an adjusting period set in advance from a point after a power is supplied to a point at which the LED circuit starts to connect electrically; and the booster circuit unit applies a voltage to the LED circuit according to the adjusting signal outputted from the duty ratio adjusting circuit unit.

(Supplementary Note 11)

The LED driving method as depicted in Supplementary Note 10, wherein:

a voltage monitoring circuit unit provided separately monitors an anode voltage of the LED circuit;

the voltage monitoring circuit unit generates and outputs a control signal having a larger duty ratio than that of the PWM dimming signal in the adjusting period that is a period until the anode voltage acquired by monitoring reaches a threshold voltage that is provided in advance; and the duty ratio adjusting circuit unit generates the adjusting signal by synchronizing the control signal outputted from the voltage monitoring circuit unit with the PWM dimming signal.

INDUSTRIAL APPLICABILITY

The present invention can be employed for the liquid crystal display device and the like which use the LED backlight.

What is claimed is:

1. An LED driving circuit for controlling an LED circuit constituted with one LED or two or more LEDS, the driving circuit comprising:

a duty ratio adjusting circuit unit which generates and outputs an adjusting signal for adjusting drive of the LED circuit based on a PWM dimming signal inputted from outside; and a booster circuit unit which applies a driving voltage to the LED circuit according to the adjusting signal outputted from the duty ratio adjusting circuit unit, wherein the duty ratio adjusting circuit unit generates the adjusting signal, the adjusting signal includes a first duty ratio larger than a duty ratio of the PWM dimming signal during a first period in which the booster circuit unit applies the voltage to the LED circuit but the LED circuits does not flow a current from the booster circuit unit and the LED circuit does not emit, the adjusting signal includes a second duty ratio smaller than the first duty ratio during a second period directly after the first period and in which the booster circuit unit applies the voltage to the LED circuit, the LED circuit flows a current from the booster circuit unit and the LED circuit emits, and the booster circuit unit boosts a first voltage to a second voltage larger than the first voltage according to the adjusting signal during the first period and applies the second voltage to the LED circuit, and boosts a voltage according to the adjusting signal during the second period and applies the voltage to the LED circuit.

2. The LED driving circuit as claimed in claim 1, further comprising a voltage monitoring circuit unit which monitors an anode voltage of the LED circuit and outputs a signal based on voltage monitoring to the duty ratio adjusting circuit unit, wherein the adjusting period is a period until the anode voltage monitored by the voltage monitoring circuit unit reaches a threshold voltage that is provided in advance.

3. The LED driving circuit as claimed in claim 2, wherein the duty ratio adjusting circuit unit generated the adjusting signal by synchronizing the signal based on the voltage monitoring with the PWM dimming signal.

4. The LED driving circuit as claimed in claim 2, wherein the threshold voltage is set as a smaller value than a voltage required for lighting up all the LEDs constituting the LED circuit.

5. The LED driving circuit as claimed in claim 2, wherein the duty ratio adjusting circuit unit gradually decreases the duty ratio of the adjusting signal to be generated to bring it close to the duty ratio of the PWM dimming signal within a specific period after the anode voltage monitored by the voltage monitoring circuit unit reaches the threshold voltage.

6. The LED driving circuit as claimed in claim 1, wherein the duty ratio adjusting circuit unit calculated and sets the adjusting period based on the PWM dimming signal and operation characteristic information of the booster circuit unit.

7. The LED driving circuit as claimed in claim 1, further comprising a current monitoring circuit unit which the monitors a forward electric current flown from a cathode side of the LED circuit and outputs a signal based on current monitoring to the duty ratio adjusting circuit unit, wherein the duty ratio adjusting circuit unit adjusts the duty ratio of the adjusting signal according to the signal based on the current monitoring.

8. The LED driving circuit as claimed in claim 7, wherein the duty ratio adjusting circuit unit gradually decreased the duty ratio of the adjusting signal to be generated to bring it close to the duty ratio of the PWM dimming signal within a specific period after the forward electric current monitored by the current monitoring circuit unit starts to flow.

9. A liquid crystal display device, comprising:

a liquid crystal display panel which displays a video towards outside;

a backlight which comprises the LED circuit constituted with one LED or two or more LEDs and illuminates the liquid crystal display panel from a back surface; and the LED driving circuit claimed in claim 1.

10. The LED driving circuit as claimed in claim 1, wherein the larger duty ratio is 100%.

11. The LED driving circuit as claimed in claim 1, wherein the booster circuit unit, before the LED circuit is started to light up, stops boosting the voltage according to the duty ratio larger than that of the PWM dimming signal and applies the boosted voltage to the LED circuit.

12. An LED driving method used with an LED driving circuit which comprises a booster circuit unit which applies a driving voltage to an LED circuit constituted with one LED or two or more LEDs and a duty ratio adjusting circuit unit which generates and outputs an adjusting signal for adjusting drive of the LED circuit, wherein:

the duty ratio adjusting circuit unit inputs a PWM dimming signal used for controlling operations of the LED circuit from outside;

the duty ratio adjusting circuit unit generates the adjusting signal having a first duty ratio larger than a duty ratio of the PWM dimming signal during a first period in which the booster circuit unit applies the voltage to the LED circuit but the LED circuits does not flow a current from the booster circuit unit and the LED circuit does not emit, the adjusting signal includes a second duty ratio smaller than the first duty ratio during a second period directly after the first period and in which the booster circuit unit applies the voltage to the LED circuit, the LED circuit flows a current from the booster circuit unit and the LED circuit emits;

the booster circuit unit applies a voltage to the LED circuit according to the adjusting signal outputted from the duty ratio adjusting circuit unit; and the booster circuit unit boosts a first voltage to a second voltage larger than the first voltage according to the adjusting signal during the first period and applies the second voltage to the LED circuit, and boosts a voltage according to the adjusting signal during the second period and applies the voltage to the LED circuit.

13. The LED driving method as claimed in claim 12, wherein:

a voltage monitoring circuit unit provided separately monitors an anode voltage of the LED circuit;

the voltage monitoring circuit unit generates and outputs a control signal having a larger duty ratio than that of the PWM dimming signal in the adjusting period that is a period until the anode voltage acquired by monitoring reaches a threshold voltage that is provided in advance; and the duty ratio adjusting circuit unit generates the adjusting signal by synchronizing the control signal outputted from the voltage monitoring circuit unit with the PWM dimming signal.

14. An LED driving circuit for controlling an LED circuit constituted with one LED or two or more LEDs, the driving circuit comprising:

duty ratio adjusting circuit means for generating and outputting an adjusting signal for adjusting drive of the LED circuit based on a PWM dimming signal inputted from outside; and booster circuit means for applying a driving voltage to the LED circuit according to the adjusting signal outputted from the duty ratio adjusting circuit means, wherein the duty ratio adjusting circuit means generates the adjusting signal, the adjusting signal includes a first duty ratio larger than a duty ratio of the PWM dimming signal during a first period in which the booster circuit means applies the voltage to the LED circuit but the LED circuits does not flow a current from the booster circuit means and the LED circuit does not emit, the adjusting signal includes a second duty ratio smaller than the first duty ratio during a second period directly after the first period and in which the booster circuit means applies the voltage to the LED circuit, the LED circuit flows a current from the booster circuit means and the LED circuit emits, and the booster circuit means boosts a first voltage to a second voltage larger than the first voltage according to the adjusting signal during the first period and applies the second voltage to the LED circuit, and boosts a voltage according to the adjusting signal during the second period and applies the voltage to the LED circuit.

* * * * *